US008263891B2

(12) United States Patent
Heins et al.

(10) Patent No.: US 8,263,891 B2
(45) Date of Patent: Sep. 11, 2012

(54) ELECTRIC SWITCHING ARRANGEMENT AND MOUNTING METHOD

(75) Inventors: Volker Heins, Rheinbach (DE); Hartwig Stammberger, Alfter (DE); Bogdan Zabrocki, Neunkirchen-Seelscheid (DE); Markus Brich, Grafschaft-Leimersdorf (DE)

(73) Assignee: Eaton Industries GmbH, Bonn (DE)

( * ) Notice: Subject to any disclaimer, the term of this patent is extended or adjusted under 35 U.S.C. 154(b) by 788 days.

(21) Appl. No.: 12/303,215

(22) PCT Filed: May 18, 2007

(86) PCT No.: PCT/EP2007/004440

§ 371 (c)(1),
(2), (4) Date: Dec. 2, 2008

(87) PCT Pub. No.: WO2007/140864

PCT Pub. Date: Dec. 13, 2007

(65) Prior Publication Data

US 2010/0288732 A1 Nov. 18, 2010

(30) Foreign Application Priority Data

Jun. 3, 2006 (DE) ..... 10 2006 026 064

(51) Int. Cl.
*H01H 33/18* (2006.01)

(52) U.S. Cl. ..... 218/22

(58) Field of Classification Search ..... 218/22–34
See application file for complete search history.

(56) References Cited

U.S. PATENT DOCUMENTS

| | | | | |
|---|---|---|---|---|
| 4,237,355 | A | 12/1980 | Fechant et al. | |
| 5,589,672 | A | 12/1996 | Uchida et al. | |
| 6,300,586 | B1 * | 10/2001 | Doughty et al. | 218/148 |
| 6,518,530 | B2 * | 2/2003 | Heins et al. | 218/38 |
| 7,081,596 | B2 * | 7/2006 | Schneider et al. | 218/22 |
| 7,220,933 | B2 * | 5/2007 | Baiatu | 218/34 |

FOREIGN PATENT DOCUMENTS

| | | |
|---|---|---|
| DE | 2803249 | 8/1978 |
| DE | 4204049 | 8/1993 |
| DE | 10028076 | 10/2001 |
| EP | 0028740 | 5/1981 |
| JP | 02132716 | 5/1990 |

* cited by examiner

*Primary Examiner* — Truc Nguyen
(74) *Attorney, Agent, or Firm* — Leydig, Voit & Mayer, Ltd.

(57) ABSTRACT

An electric switching arrangement disposable in an arcing chamber, the electric switching arrangement including a busbar having a termination surface, a moving contact, a fixed contact carrier having a contact facing carrier, and a fixed contact disposed on the fixed contact carrier at a distance from the termination surface and coupled to the termination surface. The electric switching arrangement further including a ferromagnetic switch arc splitter non-positively disposed on the fixed contact carrier.

8 Claims, 4 Drawing Sheets

ELECTRIC SWITCHING ARRANGEMENT AND MOUNTING METHOD

CROSS REFERENCE TO PRIOR APPLICATIONS

This application is a U.S. National Phase application under 35 U.S.C. §371 of International Application No. PCT/EP2007/004440, filed May 18, 2007, and claims benefit to German Patent Application No. DE 10 2006 026 064.3, filed Jun. 3, 2006. The International Application was published in German on Dec. 13, 2007 as WO/2007/140864 under PCT Article 21(2).

FIELD

The present invention relates to an electric switching arrangement, and in particular an electric switching arrangement for a multi-pole low-voltage circuit breaker including a moving contact, a fixed contact and an arc splitter.

BACKGROUND

U.S. Pat. No. 5,589,672 describes an electric switching device having a fixed and a moving contact in which an arc splitter is arranged for purposes of discharging and cooling the switch arc. An arc plate runs approximately in the plane where the contacts touch each other. Two baffle plates that form a so-called slot motor are situated parallel next to the fixed contact. The contact material is made of highly conductive metal (e.g., copper); the arc splitter is made of ferromagnetic material. Owing to the different materials, the parts of the contact(s) and the arc splitter have to be manufactured as separate structures that are then connected to each other when the switching device is assembled. According to U.S. Pat. No. 5,589,672, the arc splitter is screwed from below onto the fixed contact. Another possibility is to employ spot welding or riveting.

The state of the art described above has the drawback that the mounting of an arc splitter onto the fixed contact is time-consuming.

SUMMARY

It is an aspect of the present invention to provide forward a switching arrangement with a switch arc splitter (and a mounting method) in which the arc splitter can be mounted in a simple manner.

In an embodiment, the present invention provides an electric switching arrangement disposable in an arcing chamber, the electric switching arrangement including a busbar having a termination surface, a moving contact, a fixed contact carrier having a contact facing carrier, and a fixed contact disposed on the fixed contact carrier at a distance from the termination surface and coupled to the termination surface. The electric switching arrangement further includes a ferromagnetic switch arc splitter non-positively disposed on the fixed contact carrier.

BRIEF DESCRIPTION OF THE DRAWINGS

Additional details and advantages of the invention can be gleaned from the embodiment below explained on the basis of the figures. The following is shown.

DETAILED DESCRIPTION

Figure 1:
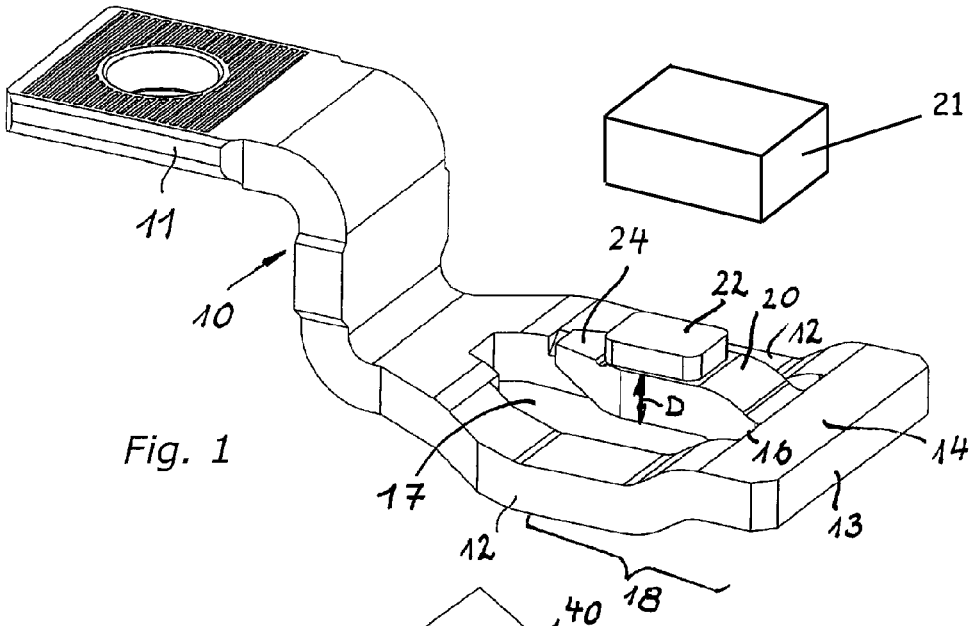
FIG. 1 is a perspective view of the busbar in accordance with an embodiment of the present invention.

An embodiment of the present invention provides a switch arc splitter that can be non-positively mounted on the fixed contact carrier.

The switch arc splitter is configured as an inlay element that can be non-positively mounted in a receiving opening on the contact facing carrier.

The switch arc splitter can thus be affixed to the busbar of the fixed contact carrier without a need for welding, riveting or screwing.

The switch arc splitter includes an elongated base element on which—in the mounted state on the fixed contact carrier—at least one baffle plate is formed on a front part at a distance from the termination surface, a discharge horn is formed on its rear part close to the termination surface, and a mounting window is formed in the center.

A receiving tab is arranged on the contact facing carrier and it is oriented towards the termination surface, as seen from a cross strut arranged on the fixed contact carrier at a distance from the termination surface. Then two placement surfaces that form the upper and lower edges of a mounting window, of which the upper placement surface—during the mounting procedure—comes to lie above the receiving tab while the lower placement surface—during the mounting procedure—comes to lie below the receiving tab, and whereby the distance between the placement surfaces, which are approximately parallel to each other, is less than the thickness of the receiving tab. The switch arc splitter can be slid onto the receiving tab so as to glide on the contact facing carrier, after which the switch arc splitter is fastened to the contact facing carrier by means of clamping.

Furthermore, a reference surface is defined to which—for purposes of explaining the geometric details—other dimensions are related. The reference surface includes the contact surface of the upper placement surface with the surface of the receiving tab.

Furthermore, a direction is defined above as well as below the reference surface in such a way that elements of the busbar and of the switch arc splitter that come to lie in the quenching chamber of the switching arrangement are designated as being located above the reference surface (or at the top).

Another preferred embodiment of the present invention includes a switch arc splitter that can be affixed to the busbar as a three-point latching.

For this purpose, it is provided that the surface of the cross strut is positioned below the reference surface by the distance of one strut and that a catch is arranged on at least one baffle plate, said catch being positioned below the reference surface by the distance of one catch when the switch arc splitter has been slid onto the receiving tab, whereby the catch distance is greater than the strut distance, so that the at least one catch comes to lie below the reference surface. The surface of the cross strut and the surface of the receiving tab should be approximately parallel to each other.

On the front part of the switch arc splitter, there is at least one catch that is positioned below the reference surface by the distance of one catch when the switch arc splitter has been slid onto the receiving tab, whereby the catch distance is greater than the strut distance. After the at least one catch has been slid onto the receiving tab, it comes to lie below the edge of the cross strut that faces the receiving opening. If an elastic deformation is made, the slid-on switch arc splitter can be raised above the cross strut edge and can be pushed forward over the cross strut edge when a force having a vector parallel to the reference surface is applied. The at least one catch comes to lie on the cross strut.

For reasons of symmetry, two catches can be provided, one of which is arranged on the front edge (as seen in the direction of the cross strut) on the baffle plates.

Preferably, the contact arrangement can also be configured on a double-break switching arrangement. In other words, this is an embodiment in which the arrangement according to the present invention is present twice on a circuit-breaker pole.

During the mounting of a switch arc splitter according to the present invention, the switch arc splitter is slid onto the receiving tab. The precisely fitting arrangement of the mounting window on the receiving tab is sufficient to secure the switch arc splitter. Here, two-point clamping onto the receiving tab is achieved. This embodiment suffices for many application cases. However, in order for the switch contact to meet higher requirements, it is recommended to use the preferred embodiment of the present invention in which three-point latching of the switch arc splitter is ultimately achieved.

In this case, two additional mounting steps are employed.

Second mounting step: application of a force exerted from below the reference surface in order to elastically deform the front part of the switch arc splitter, by means of which the front part is moved towards the reference surface, so that the at least one catch is raised at least into the plane of the surface of the cross strut.

Third mounting step: application of a force exerted in the plane of the reference surface, towards the cross strut, so that the at least one catch is slid onto the surface of the cross strut and comes to lie there.

As shown in FIGS. 1 and 2, the fixed contact is arranged at the end 13 of a busbar 10—preferably made of copper—whereby the fixed contact carrier has a receiving opening 17. The receiving opening 17 is closed by a cross leg 14 that is present opposite from the termination surface of the busbar. The termination surface 11—in accordance with the depiction in the figure—is configured as a fastening lug having a fastening bore.

Two side legs 12 are situated on both sides of the receiving opening 17, resulting in a divided current path from the termination surface of the busbar all the way to the contact facing 22. The contact facing 22 rests on a contact tab 20 that extends inwards into the above-mentioned receiving opening 17 on the cross leg 14. The currents that are divided in the side legs are reunited in the contact tab 20. The busbar is angled approximately in a Z-shape, so that the termination surface 11 and the fixed contact carrier 18, including the contact tab 20, are approximately parallel to each other.

The dimensions of the side legs 12, of the cross leg 14 and of the contact tab 20 are adapted to the current-carrying capacity required in the switching arrangement. The arrangement according to an embodiment of the present invention, however, is not dependent on the present or required geometric dimensions. According to the drawing, the widths (and likewise the conductor cross sections) of the two side legs, of the cross leg and of the contact tab are approximately the same.

The width of the receiving opening 17 is larger than the width of the contact tab 20, since—as will be explained in greater detail—the baffle plates 33 of the arc splitter can also extend through the receiving opening. For this reason, the width of the receiving opening is dimensioned in such a way that there is still enough room for the double material thickness of the baffle plates (in addition to the width of the base element 32).

The contact tab 20 projects upwards out of the plane where the contact carrier 18, the two side legs and the cross strut 14 are situated (in the direction of the termination surface). In this manner, the termination surface 11 of the busbar, the cross strut 14 and the contact tab 20 are situated in three approximately parallel planes, whereby the contact tab 20 is located between the plane of the termination surface 11 and the surface of the cross strut 14. In the (later) installed position of the fixed contact in the arcing chamber, the contact tab 20 (together with the arc splitter arranged on the contact tab) is located in the arc quenching chamber of the switching arrangement. Furthermore, the position of the individual parts oriented towards the quenching chamber is designated as upper layers or as 'up'.

The receiving tab 24 on the contact facing carrier 20 is oriented in the direction of the termination surface—as seen from the cross strut 14 of the fixed contact carrier. For the current flow, the fact that the contact tab 20 is bent back towards the termination surface of the busbar means that an electrodynamic opening force occurs at the place where contact is made between the fixed contact (contact facing 22) and the moving contact 21, said force stemming from the opposite course of the electric current in the side legs 12 and in the contact tab 20. In the case of an elevated fault current, a force is created for purposes of supporting the contact opening. The movable contact is coupled to a breaker latching arrangement in a familiar manner.

As the contacts open, the switch arc is formed that has to be discharged and quenched as quickly as possible by the contact facing 22—on the discharge horn 40. The arc splitter 30 including a ferromagnetic material is used for this purpose. The arc splitter 30 causes the magnetic flux density in the contact area to be amplified, since the magnetic field lines are bundled together by the arc splitter. This brings about an acceleration of the opening pivoting movement of the moving contact brought about by the electrodynamic repulsive forces between the fixed contact and the moving contact, as a result of an excess fault current.

Figure 2A:
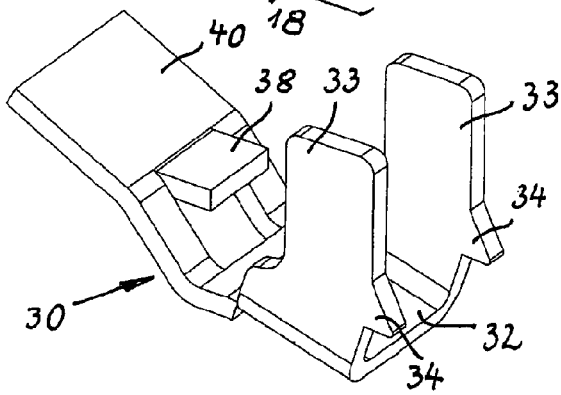
FIG. 2A is a perspective view of the switch arc splitter in accordance with an embodiment of the present invention.

The arc splitter 30 shown in FIG. 2A includes a flat metal sheet made of steel. The special shape is created by means of stamping and bending.

The base element of the arc splitter 30 is an elongated base object 32 including a front part that supports the baffle plate 33 and a rear part that encompasses a discharge horn 40. The two baffle plates 33—bent at approximately at a right angle—are arranged on the side of the front part. The width of the arc splitter is somewhat smaller than the width of the receiving opening 17.

Symmetrically to the longitudinal axis in the arc splitter, there is an opening or a mounting window into which the receiving tab 24 projects during the mounting procedure. The upper and lower edges of the mounting window form two placement surfaces 35, 36, which will be discussed in greater detail below. The height of the window corresponds to the distance between the placement surfaces 35, 36, which are approximately parallel to each other, whereby the upper window edge is configured as a material web 38.

During the mounting procedure, the upper placement surface 35 comes to lie on the surface 25 of the receiving tab 24. The second placement surface 36 comes to lie below the receiving tab 24 during the mounting procedure. Consequently, the contact surface of the upper placement surface 35 with the surface 25 of the receiving tab 24 is defined hereinafter as reference surface BZ (see FIG. 2B). For purposes of explaining the geometric details, other dimensions will relate to the reference surface BZ.

The rear part of the base element 32 includes a discharge horn 40, is bent upwards (towards the quenching chamber) relative to the reference surface BZ (and thus relative to the material web 38 of the upper window edge) by an angle W that is within the range from 25° to 30°.

As already mentioned, the front part of the switch arc splitter 30 supports the two baffle plates 33 that extend at a right angle relative to the reference surface BZ, likewise upwards. The foot lines of the baffle plate (bevels) on the front part are below the reference surface BZ, approximately as a continuation of the line formed by the discharge horn. In each case, a catch 34 is located on the front edge of the baffle plates 33 (as seen in the direction of cross strut). As can be gleaned from FIG. 2B, the catches 34 are likewise arranged below the reference surface BZ.

As shown, the arc splitter includes three elements: firstly the arc-discharge horn 40, secondly the mounting window and thirdly the two baffle plates 33 that are arranged in a U-shape. On the sides, the baffle plates 33 delimit the contact space. The discharge horn 40 (in the assembled state) constitutes an extension of the contact tab 20 for purposes of carrying the foot of the burning switch arc away from the contact facing 22 in the direction of a quenching plate stack arranged in the quenching chamber.

Figure 2B:
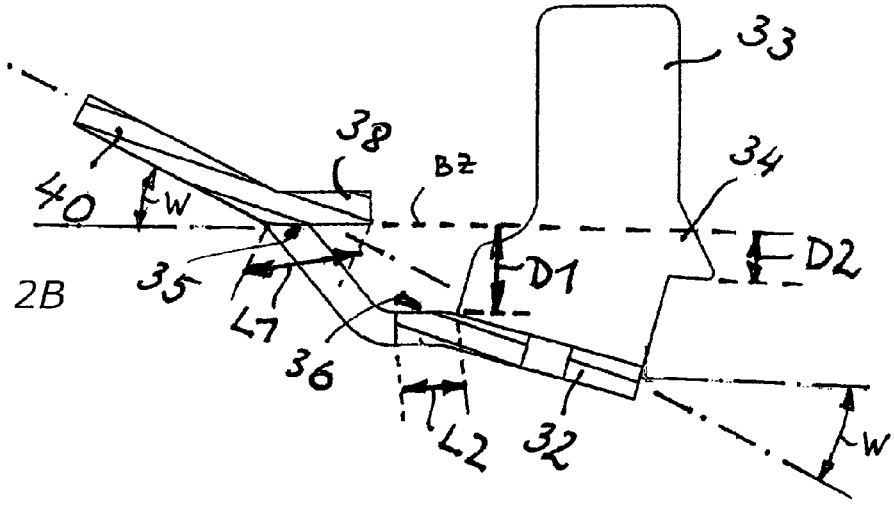
FIG. 2B is a sectional view of the switch arc splitter in accordance with an embodiment of the present invention.

The mounting window is located approximately in the middle of the lengthwise extension of the base element, where the base element is configured to be slightly bent or angled (see FIG. 2B).

Figure 3:
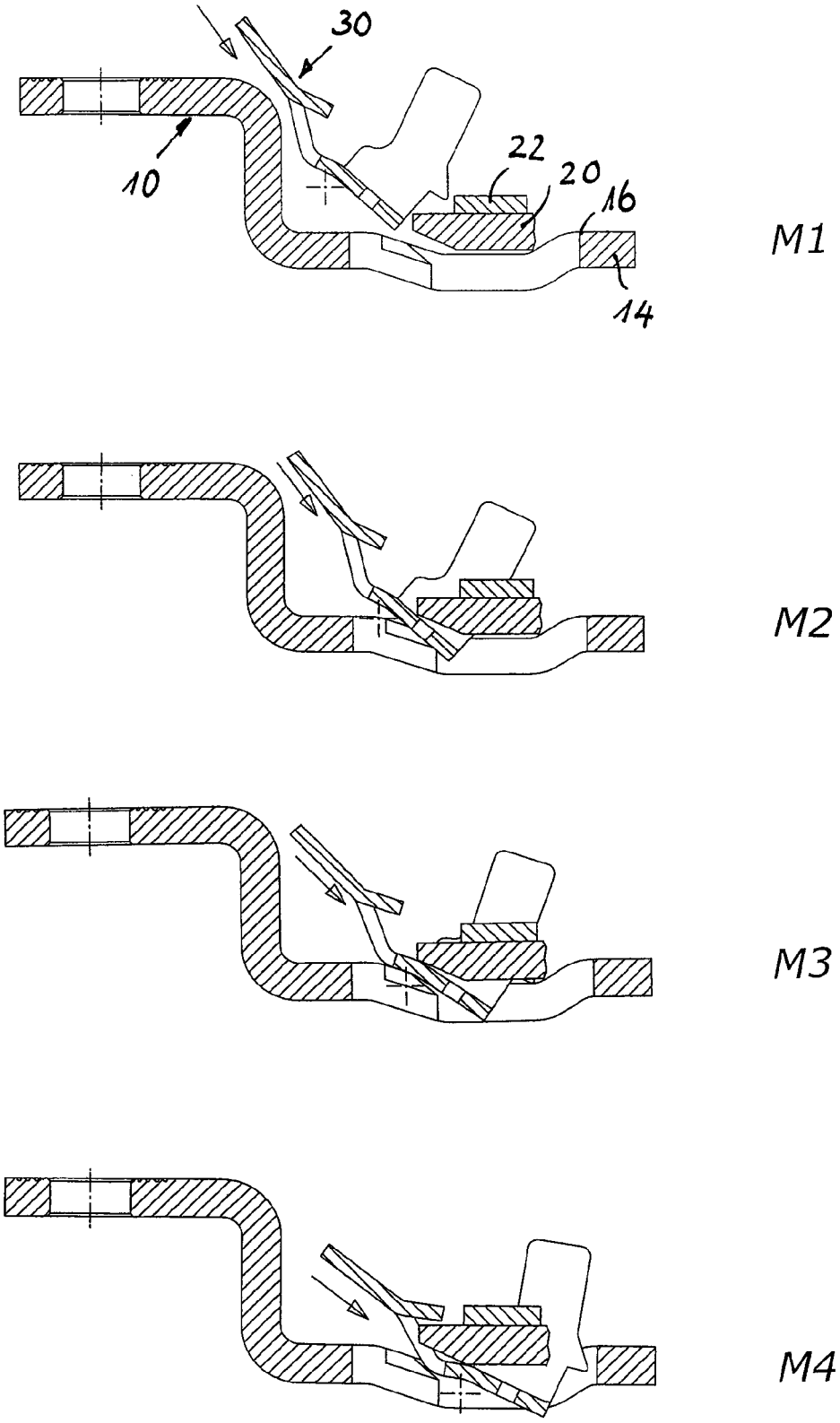
FIGS. 3 and 4 illustrate a mounting sequence (M1 to M7) of the switch arc splitter on the busbar in accordance with an embodiment of the present invention.
Figure 4:
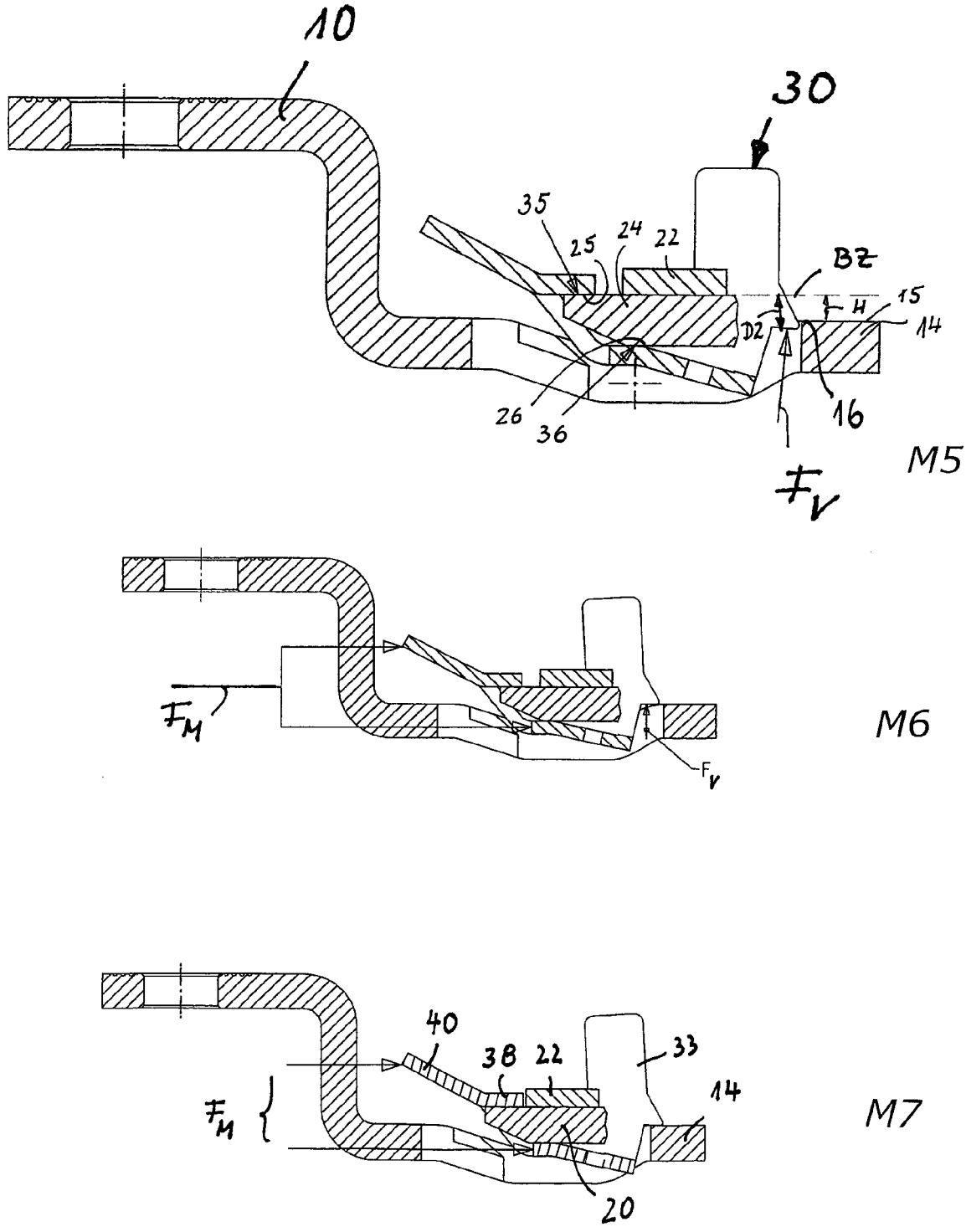

As can be seen further in the assembly sequence depicted in FIGS. 3 and 4 (M1 to M7), the mounting window of the arc splitter is slid over the receiving tab 24 so as to glide, with a movement leading from the termination surface of the busbar to the cross strut 14 of the busbar 10.

In order to achieve a non-positive fastening, the distance between the placement surfaces 35, 36 (the height of the window) is selected so as to be smaller than the thickness of the receiving tab 24. The placement surfaces form the jaws of tongs that expand in an elastically yielding manner during the mounting. Owing to the resultant elastic deformation, a two-point clamping is created on the receiving tab.

In the position in which the arc splitter 30 has been slid onto the contact facing carrier 20, the front part 'dives' into the receiving opening 17 together with the catches 36 formed on the baffle plates 34. When a pressure FV is applied from below, the front part can be elastically deformed with respect to the rear part that is clamped onto the receiving tab 24 on the contact facing carrier 20, as a result of which the catches 36 are raised to such an extent that they come to lie on the edge 16 of the cross strut 14 that is oriented towards the receiving opening.

For purposes of mounting the switch arc splitter, reference is made to FIGS. 3 and 4. They show the mounting sequence of the switch arc splitter on the busbar, with the individual mounting steps M1 through M7. The partial Figures M1 to M7 are each longitudinal sections of the arrangement.

In the first phase (M1) of the mounting, the switch arc splitter is slid from above into the receiving opening.

In the subsequent phases (M2 through M5), the switch arc splitter is slid onto the receiving tab. A two-point clamping is created on the receiving tab.

In the next mounting step (M6), a force FV is exerted from below the reference surface BZ in order to elastically deform the front part of the switch arc splitter, by means of which the front part is moved towards the reference surface BZ, so that the at least one catch (or both) is raised at least into the plane of the surface 15 of the cross strut 14.

In the last mounting step, a force FM is exerted in the plane of the reference surface BZ in the direction of the cross strut 14, so that the (at least one) catch is slid onto the surface 15 of the cross strut 14, where it comes to rest. Subsequently, the three-point latching of the switch arc splitter is created.

Figure 5:
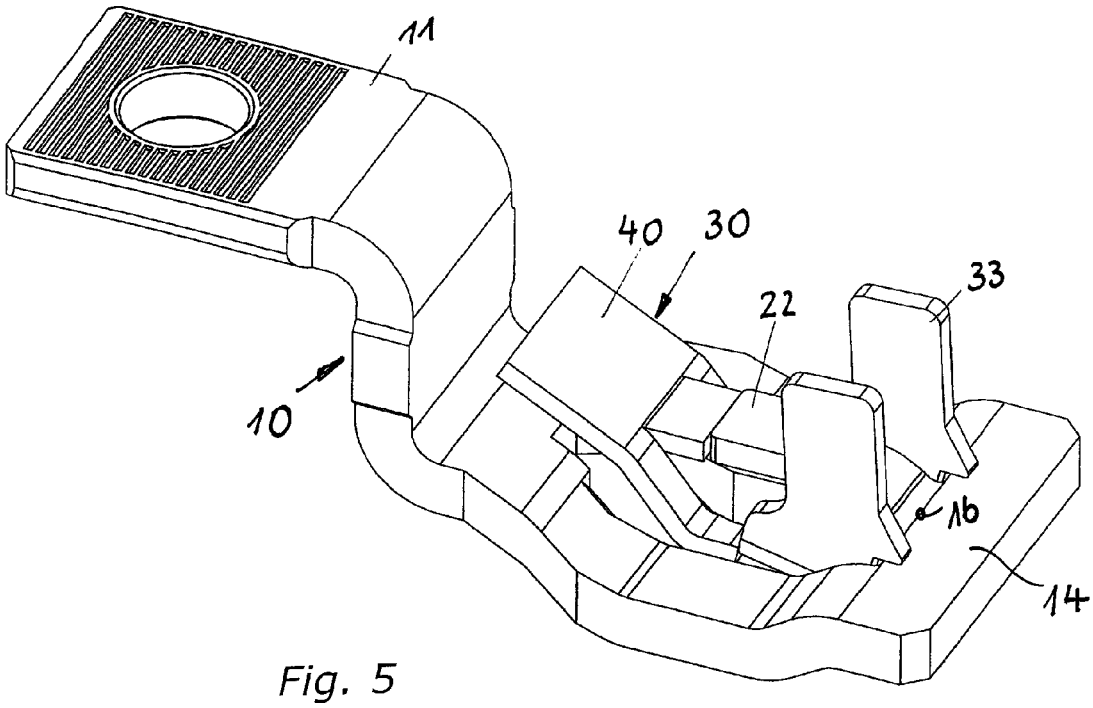
FIG. 5 is a perspective view of the busbar with the mounted arc splitter in accordance with an embodiment of the present invention.

FIG. 5 shows a perspective view of the busbar with a mounted switch arc splitter.

Figure 6:
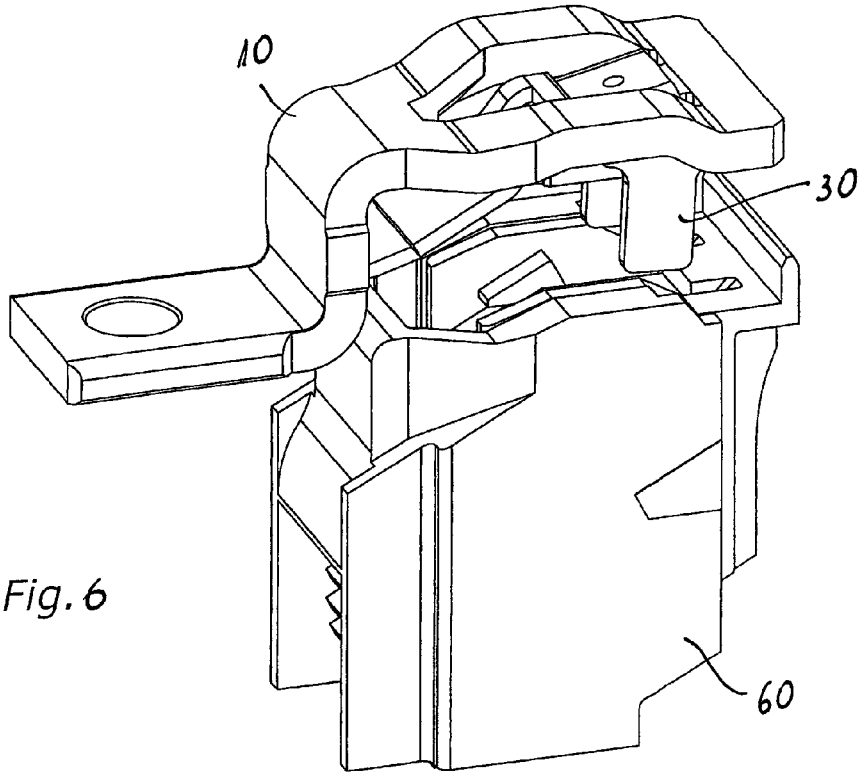
FIG. 6 shows the installed situation of the busbar with the switch arc splitter in an arcing chamber in accordance with an embodiment of the present invention.

FIG. 6 depicts a situation during the mounting of the busbar with the switch arc splitter in an arcing chamber. The switch arc splitter is located at a distance in front of the arcing chamber into which the switch arc splitter is to be slid, so that the switch arc splitter completely closes the insertion opening. A quenching plate stack of the usual type for such a switching arrangement is located in the arcing chamber.

It can be seen that the baffle plates enter the arcing chamber. Preferably, the baffle plates can be somewhat spread so that they latch when they are slid into the arcing chamber. Towards this end, both baffle plates 33 should be arranged so as to be bent by somewhat more than a right angle at the front part of the switch arc splitter. In order to assist the latching, one or both baffle plates can have a catch or the like, by means of which they can be latched in a non-positive manner.

The present invention is not limited to the embodiments described herein; reference should be had to the appended claims.

The invention claimed is:

1. An electric switching arrangement disposable in an arcing chamber, the electric switching arrangement comprising:

a busbar having a termination surface;

a moving contact;

a fixed contact carrier having a contact facing carrier;

a fixed contact disposed on the fixed contact carrier at a distance from the termination surface and electrically coupled to the termination surface; and a ferromagnetic switch arc splitter disposed on the fixed contact carrier, wherein the arc splitter includes an elongated base element having a mounting window, at least one baffle plate, and a discharge horn, the at least one baffle plate being disposed at a front portion of the elongated base element at a distance from the termination surface and the discharge horn being disposed at a rear portion of the elongated base element in a vicinity of the termination surface.

2. The electric switching arrangement as recited in claim 1, further comprising a receiving tab disposed on the contact facing carrier and projecting towards the termination surface from a cross strut disposed on the fixed contact carrier, wherein the mounting window includes an upper edge and a lower edge, the upper edge including an upper placement surface disposed above the receiving tab and the lower edge including a lower placement surface disposed below the receiving tab, wherein a distance between the upper and lower placement surfaces is less than a thickness of the receiving tab.

3. The electric switching arrangement as recited in claim 2, wherein a surface of the cross strut is disposed a first distance below a reference surface, the reference surface being defined by a contact portion of a surface of the receiving tab, and wherein a first of the at least one baffle plate includes a catch, the catch being disposed a second distance below the reference surface, the second distance being greater than the first distance.

4. The electric switching arrangement as recited in claim 3, wherein the first distance is a length of the strut.

5. The electric switching arrangement as recited in claim 3, wherein the second distance is a length of the catch.

6. The electric switching arrangement as recited in claim 3, wherein a second of the at least one baffle plate includes a respective catch.

7. The electric switching arrangement as recited in claim 6, further comprising a quenching plate stack disposed in the arcing chamber.

8. A method for mounting the switch arc splitter as recited in claim 3, the method comprising the steps of:

sliding the switch arc splitter onto the receiving tab;

elastically deforming a front portion of the switch arch splitter towards the reference surface via a force exerted from below the reference surface so that the catch is displaced onto a plane defined by a surface of the cross strut; and displacing the catch to lie on the surface of the cross strut via a force exerted in a plane defined by the reference surface towards the cross strut.

* * * * *